US005284421A

United States Patent [19]

Chlus et al.

[11] Patent Number: 5,284,421

[45] Date of Patent: Feb. 8, 1994

[54] ROTOR BLADE WITH PLATFORM SUPPORT AND DAMPER POSITIONING MEANS

[75] Inventors: Wieslaw A. Chlus, Wethersfield; David P. Houston, Glastonbury, both of Conn.

[73] Assignee: United Technologies Corporation, Hartford, Conn.

[21] Appl. No.: 980,848

[22] Filed: Nov. 24, 1992

[51] Int. Cl.[5] ..... F01D 5/10

[52] U.S. Cl. ..... 416/248; 416/500

[58] Field of Search ..... 416/248, 500

[56] References Cited

U.S. PATENT DOCUMENTS

| | | | |
|---|---|---|---|
| 3,666,376 | 5/1972 | Damlis | 416/500 |
| 3,887,298 | 6/1975 | Hess et al. | 416/500 |
| 4,101,245 | 7/1978 | Hess et al. | 416/500 |
| 4,182,598 | 1/1980 | Nelson | 416/500 |
| 4,455,122 | 6/1984 | Schwarzmann et al. | 416/190 |
| 5,228,835 | 7/1993 | Chlus | 416/500 |

*Primary Examiner*—John T. Kwon

[57] ABSTRACT

A rotor blade having axially spaced gussets disposed between a root portion and a platform is disclosed. Various construction details are developed which provide a gusset providing both platform support and damper positioning means. In one particular embodiment, a rotor blade assembly includes a plurality of circumferentially spaced rotor blades having dampers disposed between adjacent blades, wherein each blade includes an axially spaced pair of gussets extending laterally from the rotor blade. The gussets extend from a root portion of the rotor blade to a platform and provide radial support of the platform during rotation of the rotor assembly. The gussets include a curved lateral edge which, during rotation of the rotor assembly, urges the damper away from the root portion of the blade.

10 Claims, 2 Drawing Sheets

ROTOR BLADE WITH PLATFORM SUPPORT AND DAMPER POSITIONING MEANS

DESCRIPTION

1. Technical Field

This invention relates to gas turbine engines, and more particularly to a rotor assembly including a damper between adjacent rotor blades.

2. Background of the Invention

A typical gas turbine engine has an annular, axially extending flow path for conducting working fluid sequentially through a compressor section, a combustion section, and a turbine section. The compressor section includes a plurality of rotating blades which add energy to the working fluid. The working fluid exits the compressor section and enters the combustion section. Fuel is mixed with the compressed working fluid and the mixture is ignited to thereby add more energy to the working fluid. The resulting products of combustion are then expanded through the turbine section. The turbine section includes another plurality of rotating blades which extract energy from the expanding fluid. A portion of this extracted energy is transferred back to the compressor section via a rotor shaft interconnecting the compressor section and turbine section. The remainder of the energy extracted may be used for other functions.

The rotor blades of the compressor section and the turbine section are included within a rotor assembly of the gas turbine engine. The rotor assembly includes the rotor shaft and a plurality of rotating disks. The disks include attachment means for the rotor blades. Rotational forces during operation of the gas turbine engine cause significant stress within the structure of the rotor assembly. To accommodate such forces, sufficient radial support must be provided for all the rotating parts. This type of support, however, typically increases the bulk of the engine and thereby lowers operating efficiency of the engine.

Each of the rotor blades includes an airfoil portion, a platform, and a root portion. The airfoil portion extends through the flow path and interacts with working fluid to transfer energy between the rotor blade and working fluid. The platform typically extends laterally from the rotor blade and is disposed radially between the airfoil portion and the root portion. The platform includes a radially outward facing flow surface. The plurality of platforms extends circumferentially about the longitudinal axis of the gas turbine engine to define a radially inner flow surface for working fluid. This inner flow surface confines working fluid to the airfoil portion of the rotor blade. The root portion engages the attachment means of the disk.

Platforms are generally of two types. The first is a chevron type which includes lateral edges curved to approximate the airfoil shape of the rotor blade. This type of shape minimizes the lateral extension of the platform from the rotor blade. Minimizing the lateral extension or cantilevered portion of the platform minimizes the bending stress in the platform caused by rotational forces.

The second type of platform includes parallel lateral edges which extend linearly. Parallel edges provide for ease of manufacture and ease of assembly of the rotor blades into the disk. This type of platform, however, has higher bending stress than a comparable chevron platform due to the larger lateral extension. The bending stress is particularly significant in the region of the attachment of the platform to the root portion and airfoil portion of the rotor blade. To accommodate this stress, the parallel edged platform is typically made thicker, in the radial dimension, with a lateral taper towards the lateral edges. Increasing the thickness of the platform adds to the bulk of the blade.

Another concern is the vibrational energy within the rotor assembly. Vibrational energy may be destructive and shorten the expected life of various components associated with the gas turbine engine. A source of much of the vibrational energy is the interaction of the rotor blades with the working fluid. A solution to this is to provide a damper in contact with each blade to reduce the vibrational energy within the rotor blade.

A typical damper is positioned between adjacent rotor blades and engaged with the underside of adjacent platforms. One such damper is disclosed in U.S. Pat. No. 4,455,122, issued to Schwarzmann et al, entitled "Blade to Blade Vibration Damper". The damper disclosed is centrifugally urged against the underside of adjacent platforms during rotation of the rotor blades.

Another such damper is disclosed in U.S. Pat. No. 4,457,668, issued to Hallinger, entitled "Gas Turbine Stages of Turbojets with Devices for the Air Cooling of the Turbine Wheel Disc". The damper disclosed is sized and shaped to extend across the passage between rotor blades. The damper includes a back shaped to conform to the underside of the adjacent platforms such that the damper is axially retained by engagement with the platform.

A drawback to both disclosed dampers is that the dampers are not prevented from engaging the root portion of the rotor blade. Engagement between the root portion and the damper may lead to detrimental wearing of both the root portion and the damper. This is especially significant for rotor blades having a high degree of radial twist such that the root portion and platform form an acute angle along one side. The surface of the root portion along that acute angled side is subject to a greater likelihood of damaging contact.

The above art notwithstanding, scientists and engineers under the direction of Applicants' Assignee are working to develop dampened rotor blade assemblies which are easy to assemble, lightweight, and durable.

DISCLOSURE OF THE INVENTION

According to the present invention, a rotor blade includes a gusset extending radially and laterally between a root portion and a platform, the gusset providing radial support for a platform and including a radiused laterally outer edge adapted to urge a damper away from the root portion.

According to a specific embodiment of the invention, a rotor blade assembly includes a plurality of circumferentially spaced rotor blades and a plurality of dampers located between adjacent rotor blades. Each rotor blade includes an airfoil portion, a root portion, a platform disposed radially therebetween, and a pair of axially spaced gussets extending radially and laterally between the root portion and the platform. Each gusset provides radial support for the platform and includes a radiused laterally outer edge adapted to urge the damper radially outward and away from the root portion. Each gusset further includes a nub which extends laterally and is engaged with the damper to axially retain the damper.

A principle feature of the present invention is the gusset extending between the root portion and the platform. Another feature is the curved, laterally outward facing surface of the gusset. A feature of a specific embodiment is the axial spacing of the pair of gussets and the nub extending laterally form each gusset.

A primary advantage of the present invention is the ease of assembly of the rotor assembly as a result of the radial support provided the platform by the gusset. The gusset permits the use of platforms having parallel lateral edges by providing radial support to react the bending moment within the platform resulting from rotation of the rotor assembly. Another advantage of the present invention is the elimination of degrading wear between the damper and the root portion as a result of the stand-off and damper positioning provided by the gusset. The gussets extend from the root portion to prevent contact between the damper and root portion due to lateral movement of the damper. In addition, the gusset includes a radiused surface facing the damper to urge the damper radially outward and laterally away from the root portion during rotation of the rotor assembly. The radiused surface encourages the damper to remain in a position extending between adjacent platforms. An advantage of the particular embodiment is the maintenance of proper axial positioning of the damper as a result of the pair of nubs extending from the gussets and retainingly engaged with the damper.

The foregoing and other objects, features and advantages of the present invention become more apparent in light of the following detailed description of the exemplary embodiments thereof, as illustrated in the accompanying drawings.

BEST MODE FOR CARRYING OUT THE INVENTION

Figure 1:
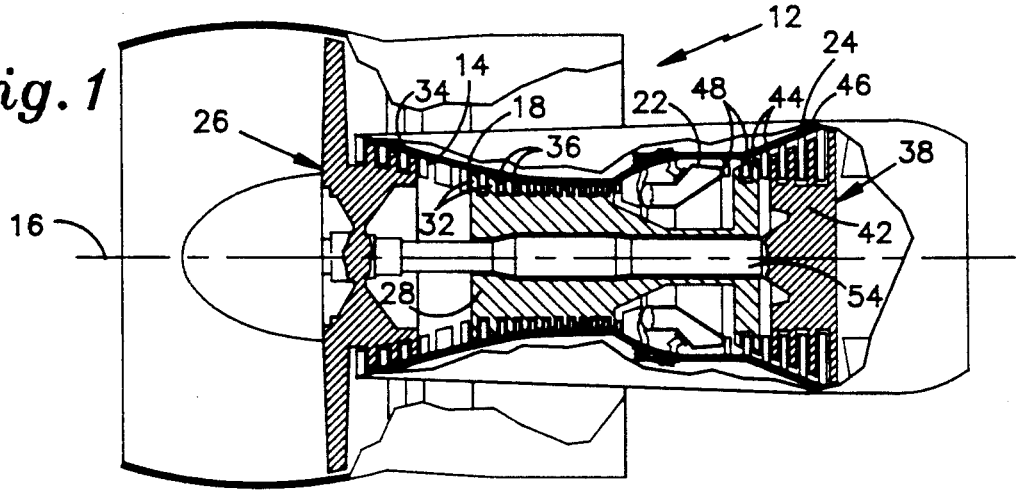
FIG. 1 is a cross sectional side view of a gas turbine engine.

FIG. 1 illustrates a gas turbine engine 12 having an axially oriented flow path 14 disposed about a longitudinal axis 16 and including a compressor 18, a combustor 22, and a turbine 24. The compressor includes a rotor assembly 26 including a plurality of rotating disks 28, each disk having a plurality of circumferentially spaced blades 32 extending therefrom, and a stator assembly 34 including a plurality of vanes 36 extending through the flow path. The compressor blades are engaged with working fluid flowing through the flow path to transfer energy to the working fluid. The working fluid exits the compressor and enters the combustor where it is mixed with fuel and ignited. The products of combustion are expanded through the turbine. The turbine includes a turbine rotor assembly 38 including a plurality of disks 42, each disk including a plurality of circumferentially spaced blades 44 extending through the flow path, and a stator assembly 46 including a plurality of vanes 48 extending through the flow path. The turbine rotor blades are engaged with the expanding products of combustion to transfer energy from the working fluid to the blades. A portion of this energy is then transferred to the compressor via a pair of rotor shafts 52,54 interconnecting the turbine and compressor. In this way a portion of the energy transferred to the turbine is used to compress incoming working fluid.

Figure 2:
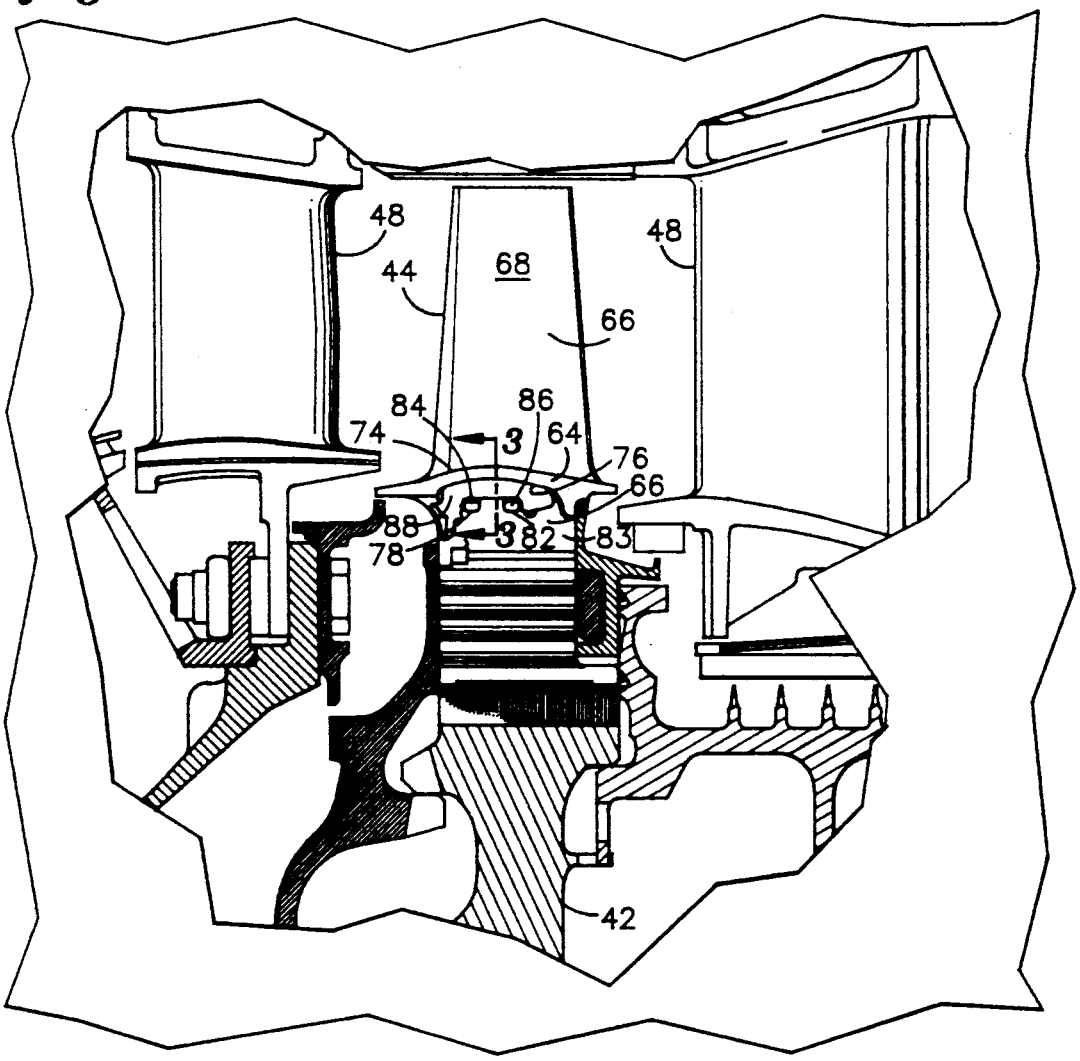
FIG. 2 is a partially sectioned side view of a rotor assembly and a damper.
Figure 3:
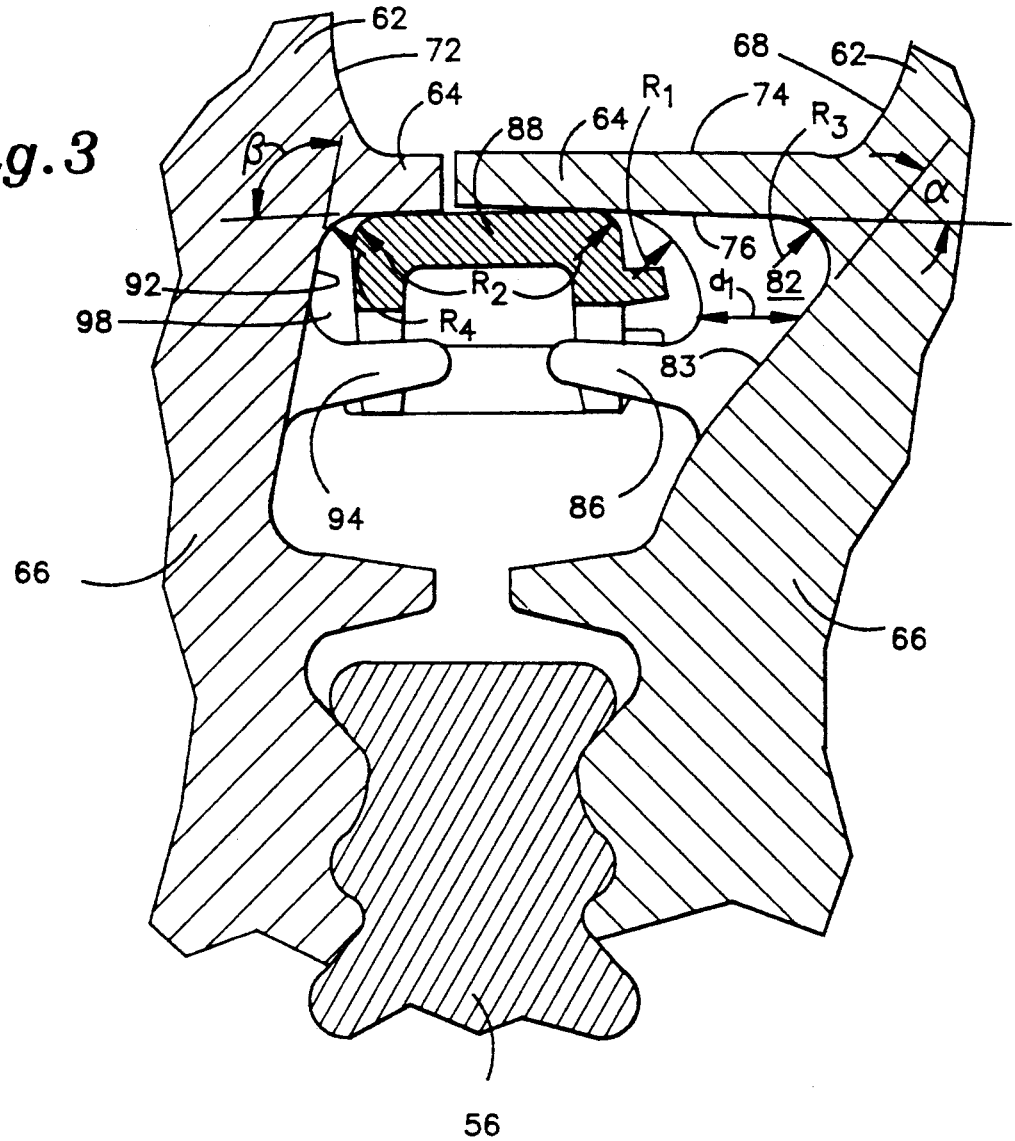
FIG. 3 is a sectional, axial view of a rotor assembly showing a rotor blade having a gusset, and showing the damper and a damper cavity between adjacent rotor blades.

Referring now to FIGS. 2 and 3, a portion of the turbine rotor assembly is shown. The disk includes an attachment means 56 for securing each of the turbine rotor blades to the disk. As shown in FIG. 3, the attachment means is comprised of a standard fir tree type retention engaged with each of the blades. Each of the blades includes an airfoil portion 62, a platform 64, and a root portion 66. The airfoil portion extends radially through the flow path and includes a pressure surface 68 and a suction surface 72. The root portion is engaged with the attachment means to secure the blade to the disk. The platform is located radially between the airfoil portion and the root portion and extends laterally about the blade. The platform includes a radially outer surface 74, which, in conjunction with the outer surfaces of the other platforms defines a flow surface for the working fluid, and a radially inner surface 76.

An axially spaced pair of gussets 78,82 extend between the pressure surface side of the neck 83 and the radially inner surface 76 of the platform. Each gusset includes a laterally projecting nub 84,86 which is engaged with a damper 88 to provide means of axial retention for the damper. The suction surface side of the neck 92 also includes an axially spaced pair of nubs 94 which extend directly from the neck. The four nubs in conjunction provide both axial retention and radial support to t he damper within the damper cavity 98.

Figure 4:
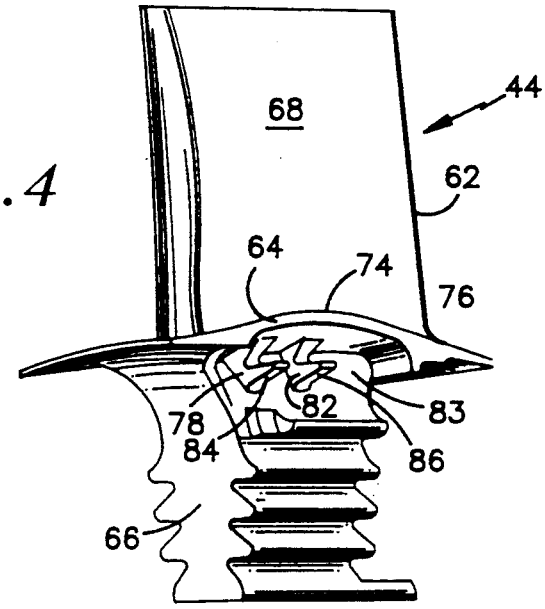
FIG. 4 is a perspective view of the rotor blade showing the pair of gussets with nubs extending laterally.

The gussets as shown in FIGS. 2–4 extend from the pressure surface side of the neck to approximately the lateral mid point of the pressure surface side of the platform. The pair of gussets provide radial support for the cantilevered platform. The gussets include a lateral edge which is radiused near the junction with the platform. The radius of the lateral edge $R_1$ is greater than the corresponding radius $R_2$ of the outer corner of the damper. The outer corner of the damper may engage the lateral edge of the gusset upon sufficient lateral movement of the damper within the damper cavity. The distance between the lateral edge and the root portion provides a stand-off to prevent contact between the damper and the pressure surface side of the root portion. Without the gusset, contact between the side of the damper and the pressure surface side of the root portion may occur because of the acute angle $\alpha$ formed between the platform and the root portion. The radius $R_3$ at the juncture will not prevent such contact.

During operation, rotation of the rotor assembly generates rotational forces which urge the damper radially outward to engage the adjacent platforms. Engagement between the damper and the adjacent platforms reduces the level of vibrational energy within the rotor blades. For maximum effectiveness of the damper, the damper must be properly located against the underside of the platforms. If the damper moves laterally towards the pressure surface side of the adjacent blade, the outer edge of the damper will engage of the lateral edge of the gussets. Due to the larger radius of the lateral edge relative of the radius of the outer edge of the damper, engagement of the damper with the gussets in conjunction with the rotational forces will urge the damper laterally away from the pressure surface of the blade and thereby provide damper positioning means. This prevents the damper from rubbing against the neck of the blade and degrading the damper end or the neck portion of the blade. If the damper moves laterally away from the pressure side neck portion and towards the suction side neck, the juncture between the suction side neck and the platform is also radiused and has a radius $R_4$ greater than the radius of the adjacent outer edge of the damper. The combination of the rotational force and the radius of the juncture between the suction side neck and the platform wall urge the damper to move laterally away from the suction surface side. In addition, the obtuse angle $\beta$ formed between the suction surface side and the platform will block contact.

To prevent the damper from becoming misaligned axially the nubs provide means to axially retain the damper. As shown in FIGS. 2 and 3, the nubs extends radially under and between the upstream end and the downstream end of the damper. The nubs provide a loose retention of the damper such that during rotation of the rotor assembly there should little or no contact between the damper and the nubs. During a non-operational condition of the gas turbine engine the nubs provide radial support for the damper. In addition, the nubs confine the damper to a limited space such that the damper may not rotate about a longitudinal axis and become misaligned within the damper cavity.

Although shown as a turbine rotor blade, it should be understood by those skilled in the art that the present invention has applicability to other rotor blades, such as compressor rotor blades. Additionally, it should be apparent to those skilled in the art that different quantities of gussets may be used as desired.

Although the invention has been shown and described with respect with exemplary embodiments thereof, it should be understood by those skilled in the art that various changes, omissions, and additions may be made thereto, without departing from the spirit and scope of the invention.

What is claimed is:

1. A blade assembly for an axial flow turbine engine, the turbine engine having an annular flow path disposed about a longitudinal axis, the blade assembly adapted to rotate about the longitudinal axis during operation of the turbine engine, the blade assembly including:

a plurality of blades circumferentially spaced about the longitudinal axis, each blade including an airfoil portion, a platform, and a root portion, the airfoil portion extending through the flow path and having a pressure surface and a suction surface, the platform disposed radially inward of the airfoil portion, extending laterally about the blade, and including a radially inward facing surface, the root portion disposed radially inward of the platform and the airfoil portion, the root portion having a neck disposed at the radially outward end of the root portion, the neck including a pressure surface side and a pair of gussets axially spaced and extending from the pressure surface side of the neck, each gusset extending from the neck to the radially inward facing surface of the platform and having a lateral surface with a radius of curvature $R_1$ at the juncture of the gusset and the platform, the gussets adapted to provide radial support of the pressure side platform during rotation of the blade assembly; and a plurality of dampers, each damper disposed circumferentially between adjacent root portions, engaged with the radially inner facing surface of the platforms during rotation of the blade assembly about the longitudinal axis, and each damper having a lateral edge with a radius of curvature $R_2$, wherein rotation of the blade assembly urges the damper radially outward and into engagement with the radially inward facing surface of the platform, wherein upon sufficient relative lateral movement between the damper and the adjacent pressure side neck the damper engages the lateral surface of the gusset, and wherein $R_1 > R_2$ such that engagement of the damper with the gusset during rotation of the blade assembly encourages the damper to move radially outward and laterally away from the pressure side neck surface.

2. The blade assembly according to claim 1, wherein each of the gussets further includes a nub extending laterally from the gusset, the nub adapted to engage one of the dampers to axially retain the damper.

3. The blade assembly according to claim 2, wherein the platform includes linearly extending, parallel lateral edges, and wherein the pressure surface side of the neck and the radially inward facing surface of the platform an angle $\alpha$, and wherein $\alpha < 90°$.

4. The blade assembly according to claim 1, wherein the platform includes linearly extending, parallel lateral edges.

5. The blade assembly according to claim 1, wherein the pressure surface side of the neck and the radially inward facing surface of the platform form an angle $\alpha$, and wherein $\alpha < 90°$.

6. A rotor blade for an axial flow gas turbine engine, the turbine engine having an annular flowpath disposed about a longitudinal axis and including a rotor assembly, the rotor assembly including a plurality of the rotor blades and a plurality of dampers, the plurality of rotor blades circumferentially spaced about the longitudinal axis, each of the dampers disposed between adjacent rotor blades and having a lateral edge with a radius of curvature $R_2$, the rotor blade including:

an airfoil portion, a platform, and a root portion, the airfoil portion extending through the flow path and having a pressure surface and a suction surface, a platform disposed radially inward of the airfoil portion, extending laterally about the blade, and including a radially inward facing surface, the root portion disposed radially inward of the platform, the root portion having a neck disposed at the radially outward end of the root portion, the neck including a pressure surface side and a pair of gussets axially spaced and extending from the pressure surface side of the neck, each gusset extending from the neck to the radially inward facing surface of the platform and having a lateral surface with a radius of curvature $R_1$ at the juncture of the gusset and the platform, the gussets providing radial support of the pressure side platform during rotation of the blade assembly; and wherein rotation of the blade assembly urges the damper radially outward and into engagement with the radially inward facing surface of the platform, wherein upon sufficient relative lateral movement between the damper and the pressure surface side of the neck, the damper engages the lateral surface of the gusset, and wherein $R_1 > R_2$ such that engagement of the damper with the gusset during rotation of the blade assembly encourages the damper to move radially outward and laterally away from the pressure side surface of the neck.

7. The rotor blade according to claim 6, wherein each of the gussets further includes a nub extending laterally from the gusset, the nub adapted to engage one of the dampers to axially retain the damper.

8. The rotor blade according to claim 7, wherein the platform includes linearly extending parallel lateral edges, and wherein the pressure surface side of the neck and the radially inward facing surface of the platform an angle $\alpha$, and wherein $\alpha < 90°$.

9. The rotor blade according to claim 6, wherein the platform includes linearly extending, parallel lateral edges.

10. The rotor blade according to claim 6, wherein the pressure surface side of the neck and the radially inward facing surface of the platform form an angle $\alpha$, and wherein $\alpha < 90°$.

* * * * *